US005868015A

United States Patent [19]

Eaker

[11] Patent Number: 5,868,015

[45] Date of Patent: Feb. 9, 1999

[54] MULTIPLE ACCESS LOCKING DEVICE

[76] Inventor: David Andrew Eaker, 16248 Marvin Rd., Charlotte, N.C. 28277

[21] Appl. No.: 908,992

[22] Filed: Aug. 8, 1997

[51] Int. Cl.[6] ..... E05B 65/06; E05B 39/02

[52] U.S. Cl. ..... 70/129; 292/148; 292/337; 70/DIG. 56; D8/341

[58] Field of Search ..... 70/56, 134, DIG. 56, 70/129; 292/147, 148, 337, 346, 150; D8/341, 339

[56] References Cited

U.S. PATENT DOCUMENTS

| | | | |
|---|---|---|---|
| D. 267,698 | 1/1983 | Domes . | |
| D. 268,478 | 4/1983 | Domes . | |
| 1,364,749 | 1/1921 | Graybeal . | |
| 2,707,125 | 4/1955 | Ritter, Sr. . | |
| 2,856,220 | 10/1958 | Easley . | |
| 3,603,629 | 9/1971 | Windham . | |
| 3,656,788 | 4/1972 | Emery . | |
| 3,889,497 | 6/1975 | Tuttle . | |
| 3,988,031 | 10/1976 | Meyer . | |
| 4,185,860 | 1/1980 | Bondi | 70/129 |
| 4,214,783 | 7/1980 | Boegeman | 292/150 |
| 4,418,551 | 12/1983 | Kochackis . | |
| 4,491,354 | 1/1985 | Williams . | |
| 4,545,150 | 10/1985 | Williams . | |
| 4,687,238 | 8/1987 | Mintz . | |
| 4,697,443 | 10/1987 | Hillin . | |
| 4,877,275 | 10/1989 | DeForrest, Sr. . | |
| 4,997,219 | 3/1991 | Carter . | |
| 5,588,314 | 12/1996 | Knezovich | 70/56 |

FOREIGN PATENT DOCUMENTS

| | | | |
|---|---|---|---|
| 2275961 | 9/1994 | United Kingdom | 292/145 |

*Primary Examiner*—Darnell M. Boucher
*Attorney, Agent, or Firm*—Bell Seltzer Intellectual Property Law Group of Alston & Bird LLP

[57] ABSTRACT

A multiple access locking device is provided which is capable of being opened by any different number of users. The device includes first and second receptacle members and an elongate locking bar which, when removed from the receptacle members, allows the receptacle members to be moved relative to each other. The first receptacle member includes a tab with an opening therein and the elongate locking bar includes a similar tab with an opening. A plurality of coupling segments are placed on the locking bar between the tabs of the first receptacle member and locking bar. The coupling segments are identically configured and define a pair of radially extending tabs each having an opening for receiving a lock. Accordingly, a plurality of locks is placed through the respective openings and any one lock can unlock the multiple access device.

20 Claims, 3 Drawing Sheets

MULTIPLE ACCESS LOCKING DEVICE

FIELD OF THE INVENTION

The present invention relates to locking devices, and more particularly relates to a multiple lock device allowing multiple users to gain access to an enclosed area through a gate or the like.

BACKGROUND OF THE INVENTION

Multiple lock securing systems are useful in providing a number of persons access to a secured area. Conventional methods of addressing the "multiple user problem" include using a chain passing through two gate portions of a fence in conjunction with multiple locks whereby the U-shaped shackle of a first standard lock (which may be a combination lock) is secured to one end of the chain. Other locks are secured in series with each successive lock secured to the shackles of the adjoining locks. Eventually, the last combination lock in series is secured to the other end of the chain.

The chain and lock system as described has been useful for multiple telephone service providers who need access to the compound surrounding a commonly used cellular tower or a commonly used construction site. Unfortunately, users often inadvertently fail to follow the scheme described above when locking the chain and lock one end of the chain directly to the other end with that user's lock. Consequently, all subsequent users, who cannot open the lock of the previous user, are denied access to the area. If the situation described above occurs, the subsequent user will often be forced to cut the previous user's lock, which in turn will deny subsequent access to the owner of that lock.

Accordingly, there is a need for an improved multiple lock device which is capable of securing a gate, yet which allows multiple users to gain access to the secured area. Such a locking device would be foolproof such that under no circumstances could a user inadvertently deny access to a subsequent user.

Other types of multiple lock devices have addressed the multiple user problem and provide multiple access slide locks having a number of interlocking segments. One such device is illustrated in U.S. Design Pat. No. Des. 267,478 to Domes which depicts a device having a main lock bar in sliding engagement with a pair of fixed guides at either end of the bar. One of the guides includes a tab having a hole formed therein, apparently for receiving the shackle of a lock. A second tab is affixed to the slidable bar and also includes a hole for the shackle of a lock. An odd number of coupling segments, each having a pair of holes in a flange portion for receiving a lock shank, is provided around the main lock bar and between the tabs. One hole of one segment is aligned with one hole of an abutting segment or with one of the holes of the tabs at either end. The '478 patent depicts a first plurality of segments having a forward vertical flange and an alternating second plurality of segments having a rearward vertical flange.

Similarly, the U.S. Design Pat. No. Des. 267,698 to Domes depicts a device having a main lock bar in sliding engagement with a pair of fixed guides at either end of the bar and an odd number of coupling segments therebetween. The '698 patent includes one plurality of segments with an upper horizontal flange, and a second plurality of segments between the first plurality of segments having a lower horizontal flange. Both of these designs, however, are limited in flexibility of use because each can only function with an odd number of segments, and thus an even number of locks. If one segment was added or removed, the holes of the adjoining segments could not be aligned because the respective flanges would be of the same configuration (i.e., forward/rearward or upper/lower) and the device could not be secured. It is not always possible to predict, however, how many users should have access to the secured area, and the number may often vary. Accordingly, there is also a need for a multiple access locking device which can be configured to allow users of a nonpredetermined number to open the device.

SUMMARY OF THE INVENTION

These and other advantages and objectives are met by the multiple lock device according to the present invention which includes a plurality of identically configured coupling segments each having spaced apart openings. The openings define axes generally parallel to the axis of a locking bar so that any number of locks, whether an even number or an odd number, can be used to secure a gate or the like.

More particularly, the invention is a multiple access locking device capable of being opened by any one of a plurality of different locks to allow at least one of a pair of adjoining barrier members, such as the opposed leaves of a gate, to be moved relative to the other. The elongate locking bar has first and second opposed end portions and defines a central axis. The locking bar further includes an opening which is spaced from the central axis for receiving a lock. According to one preferred embodiment, the locking bar has a substantially cylindrical body and tab extending radially outwardly from the body adjacent to the first end portion. The opening for receiving a lock is defined in the tab spaced from the central axis of the locking bar.

The locking device includes a first receptacle member secured to one of the barrier members for receiving the first end portion of the locking bar. The first receptacle member also defines an opening for receiving a lock. According to a preferred embodiment, the first receptacle member includes a hollow tubular body and a tab extending radially outwardly from the body adjacent to the first end of the locking bar. The opening in the first receptacle member is defined in the tab.

A second receptacle member is secured to the other of the barrier members for receiving the second end portion of the locking bar. The first and second receptacle members are configured such that the barrier members are movable relative to each other when at least one of the first and second end portions of the elongate locking bar is removed from the respective receptacle member. The second receptacle member preferably has a rectangular cross section having a vertical dimension greater than a horizontal dimension.

Each of the coupling segments discussed above has a bore for receiving the elongate locking bar and further defines a pair of spaced openings. The openings each define an axis substantially parallel to the axis of the locking bar. One of the spaced openings is adjacent to the opening of the elongate locking bar such that a lock can be inserted through both the respective adjacent openings. The other of the spaced openings is adjacent the opening of the first receptacle member such that a lock can be inserted through both of the respective adjacent openings. In particular, the coupling segments each having a body defining a bore and a pair of tabs extending radially outwardly from the body adjacent the respective end of the body such that the spaced openings are defined in a respective one of the tabs.

Advantageously, the opening of the elongate locking bar and the opening of the first receptacle member each define an axis substantially parallel to the axis of the locking bar and are configured such that the coupling segment can be removed and the openings positioned adjacent to each other. Accordingly, the locking device can be locked with a single lock extending through both of the respective openings without the need for any of the coupling segments, a configuration not possible with the prior art devices.

Inasmuch as the coupling segments are all identically configured, there is no need to have an odd or even number of coupling segments. Indeed, any number of users can be accommodated by adding one coupling segment at a time, wherein the number of users having access equals the number of coupling segments plus one.

BRIEF DESCRIPTION OF THE DRAWINGS

Some of the objects and advantages of the invention have been set forth and other objects and advantages of the invention will become apparent in the detailed description of the preferred embodiments of the invention to follow, especially when taken in conjunction with the accompanying drawings, which are not necessarily drawn to scale.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
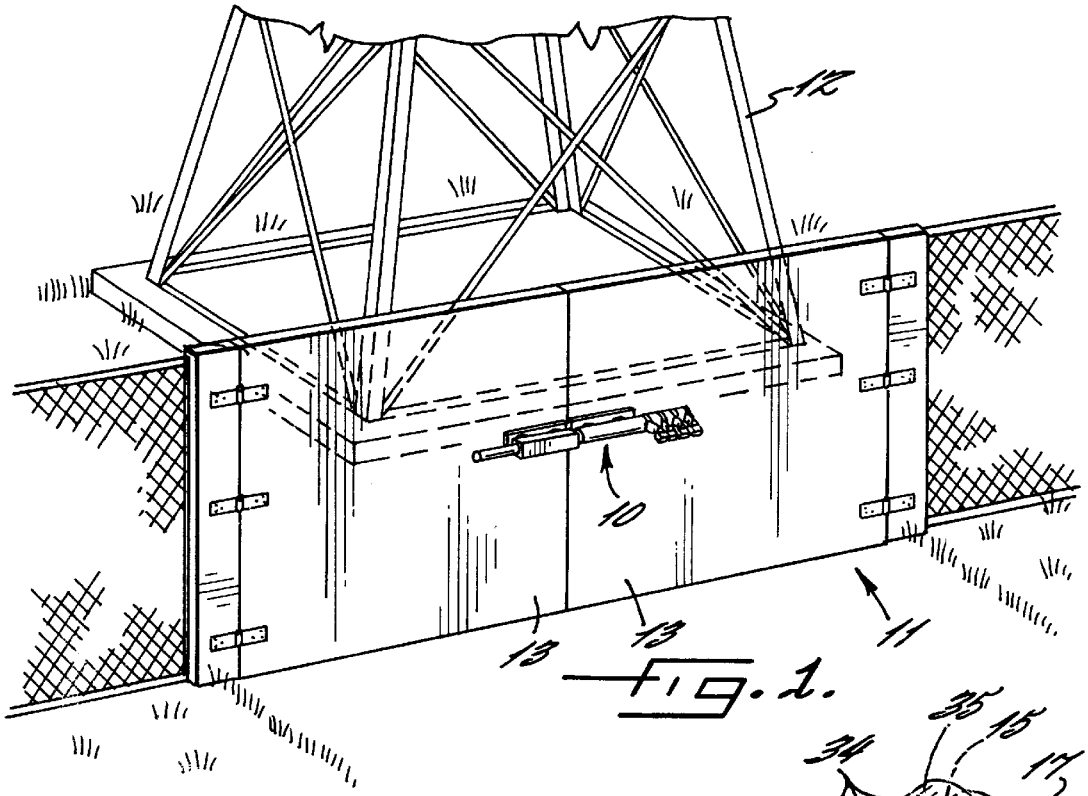
FIG. 1 is an environmental perspective view of a gate to a compound surrounding a cellular tower and illustrating a multiple access locking device according to the present invention.

FIG. 1 illustrates the use of a multiple access locking device 10 according to the present invention as used to secure a gate 11 of a compound surrounding a cellular tower 12. The gate 11 includes a pair of swingable barrier members 13, or leaves, which are movable relative to each other when the multiple access locking device 10 is unlocked. It will be understood, however, that the invention is not limited to use with a pair of swingable barrier members but may include one fixed barrier member and/or one linearly movable barrier member or any combination thereof. In addition, although illustrated as having a generally horizontal configuration, the invention could be mounted vertically or even at an inclined angle.

Figure 2:
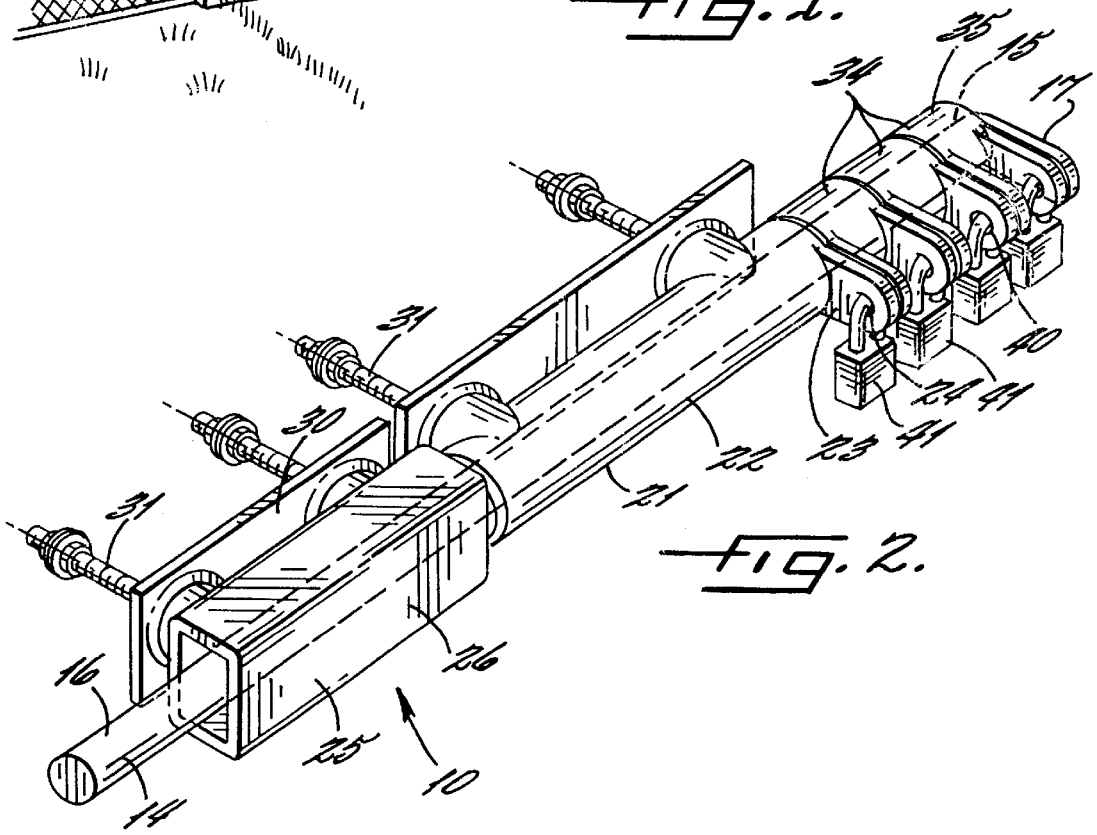
FIG. 2 an enlarged perspective view of the multiple access locking device.

FIG. 2 illustrates the various components of the multiple access locking device including an elongate locking bar 14. The locking bar 14 preferably has a steel cylindrical body defining a central axis. The elongate locking bar 14 has a first end portion 15 and a second end portion 16.

Figure 4:
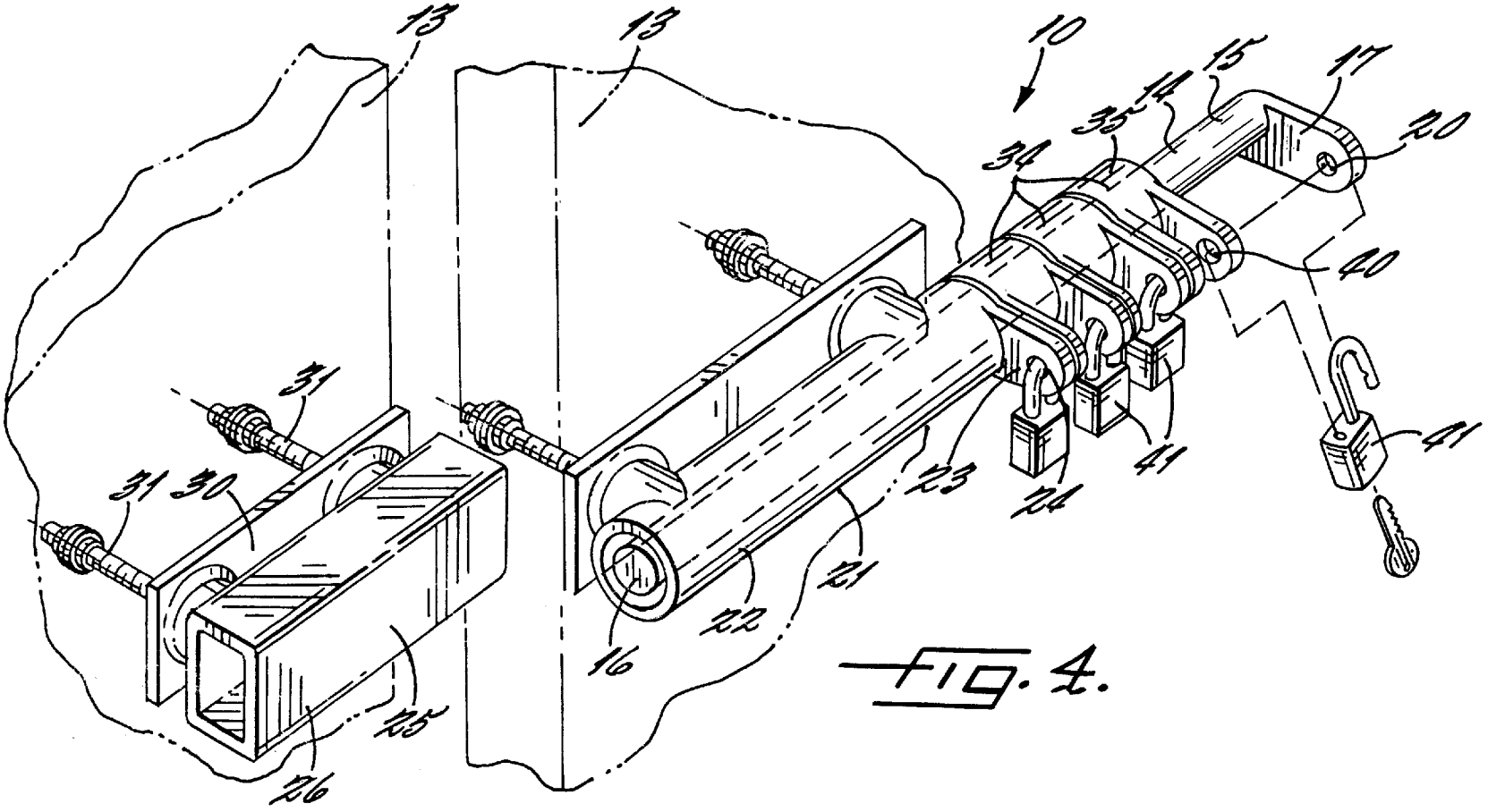
FIG. 4 is an exploded perspective view illustrating the lock of another user.

A substantially flat tab 17 is secured, such as by welding, to the body of the elongate locking bar 14, as can be best seen in FIG. 4. The tab 17 is also preferably formed of steel and extends radially outwardly from the bar 14 and defines an opening 20 which defines an axis generally parallel to the central axis of the locking bar.

The multiple access locking device 10 according to the present invention also includes a first receptacle member 21 for receiving the first end portion 15 of the locking bar 14. The first receptacle member 21 comprises a hollow tubular body 22 preferably made of steel and a tab 23 extending radially outwardly from the tubular body. The tab 23 is positioned at the end of the tubular body 22 adjacent to the first end portion 15 of the locking bar 14. The tab 23 also defines an opening 24 which defines an axis parallel to the axis of the locking bar. If it is desired that only one user have access, the shackle of a single lock can be placed through the openings 24, 20 of the first receptacle member 21 and locking bar tab 17 respectively, thereby locking the device.

A second receptacle member 25 is secured to the other of the barrier members 13 for receiving the second end portion 16 of the locking bar 14. The locking bar 14 is inserted through both the first receptacle member 21 and the second receptacle member 25 as illustrated in FIGS. 1 and 2, to securely lock the respective barrier members 13 and prevent them from moving relative to each other.

The second receptacle member is preferably formed of a hollow body 26 which defines an elongated cross section having a vertical dimension greater than a horizontal dimension. This configuration advantageously allows for some misalignment of the locking bar 14 relative to the hollow body 26 of the second receptacle member 25, which may occur as the gate 11 begins to sag over time. Although a rectangular cross section is shown, any other oblong shape, such as an oval, could be used for accommodating any such misalignment.

The second receptacle member 25 also includes means for attaching the hollow body 26 to the respective barrier member 13 of the gate 11. The attachment means may include a mounting plate 30 and a pair of bolts 31 affixed thereto. Nuts and washers are included as needed to affix securely the receptacle member to the barrier member.

At least one coupling segment 35 is arranged on the elongate locking bar 14 between the tab 17 of the locking bar and the tab 23 of the first receptacle member 21. The coupling segments 34 are identical in configuration and each includes a body 25 having a bore therethrough for receiving the elongate locking bar 14. A pair of spaced apart tabs 36 each extend outwardly from the body 35 in a radial direction. Each of the tabs 36 includes an opening 40 which defines an axis generally parallel to the axis of the locking bar 14.

Figure 3:
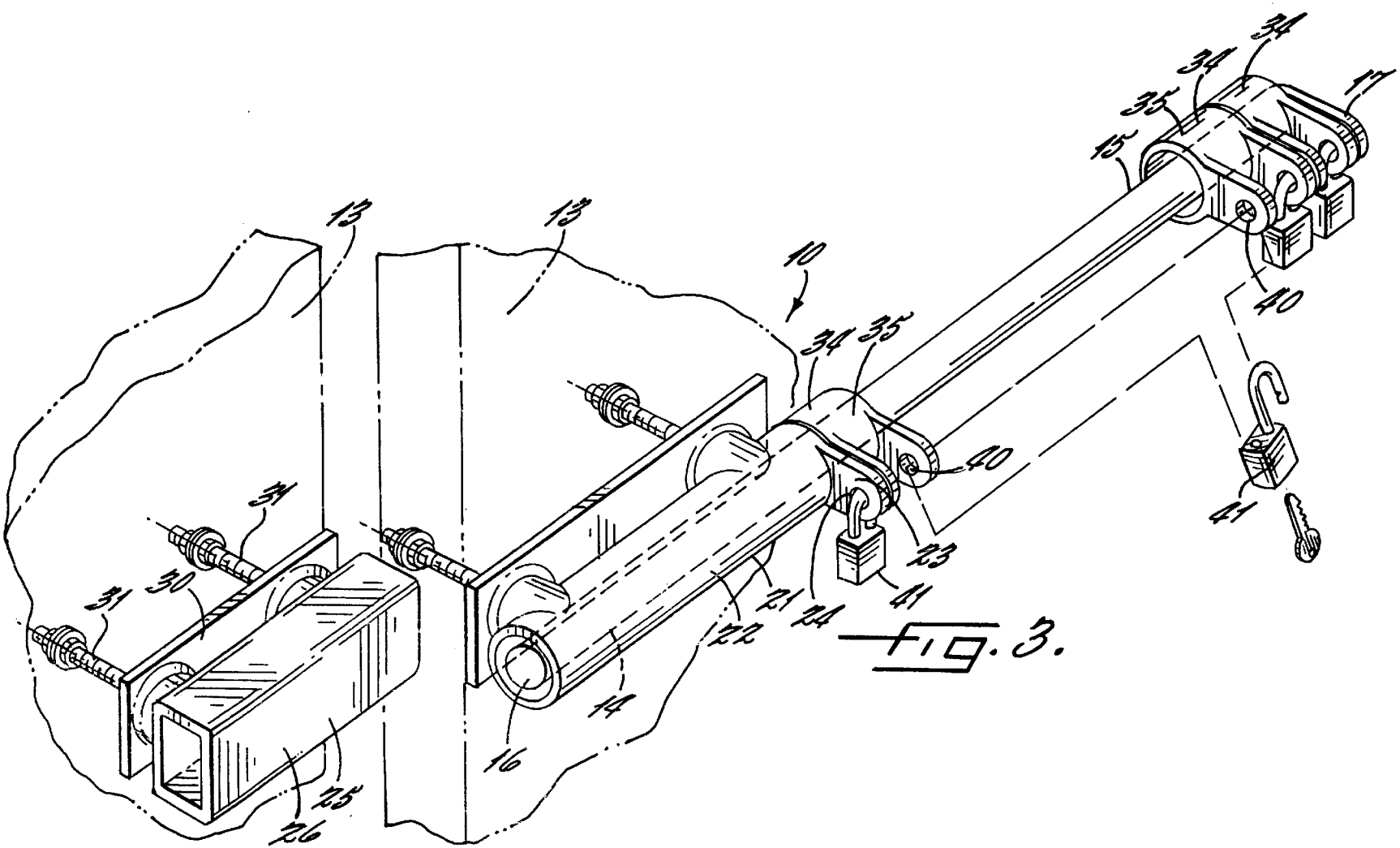
FIG. 3 is an exploded perspective view of the multiple access locking device illustrating the position of a lock of one of the users.

As can be seen, the tabs 36 are generally parallel and the openings 40 of each tab can be aligned with either the opening of a tab of an adjacent segment or with the openings 20, 23 of the locking bar 14 and first receptacle member 21, respectively. Accordingly, depending on the number of coupling segments 34, a plurality of individual locks 41 can be placed through the respective adjacent openings 20, 24, 40 to securely lock the multiple access device 10. When any user having a key to one of the locks 41 wishes to gain entry to the cellular tower compound, the respective lock 41 is opened as shown in FIGS. 3 and 4, and the locking bar 14 can be removed from at least the second receptacle member 25. The barrier members 13 will then be movable relative to each other.

FIG. 3 illustrates the situation where a lock 41 is inserted through the openings 40 of adjacent segments 35. FIG. 4 illustrates the situation where a lock is inserted through the opening 40 of a coupling segment 35 and the opening 20 of the locking bar 15.

Thus, the present invention overcomes the disadvantages of the prior art and any number of coupling segments 34 may be used to lock the device 10. More specifically, if an odd number of users is desired, an even number of segments 34 is placed on the locking bar 14 between the first receptacle tab 23 and the locking bar tab 17. If an even number of users wish to have access, an odd number of coupling segments 34 is placed on the locking bar 14. As noted above, the device is also operable with no segments and only one lock connecting the first receptacle tab 23 and locking bar tab 17.

In addition, once one of the locks 41 has been removed, all of the other locks are securely retained on either the first receptacle member 21 or the locking bar 14 so that no complicated reassembly is required when relocking the device. Moreover, the multiple locking device 10 according to the present invention is foolproof and no one lock or user can preclude subsequent users from obtaining access to the cellular compound.

Many modifications and other embodiments of the invention will come to mind to one skilled in the art to which this invention pertains having the benefit of the teachings presented in the foregoing descriptions and the associated drawings. For example, the present invention has been described with reference to the gates of a cellular tower compound, although the device could be used in other locking situations where it is desirable to secure one movable barrier member to another. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A multiple access locking device capable of being opened by any one of a plurality of different locks to allow at least one of a pair of adjoining barrier members to be moved relative to the other, said device comprising:

an elongate locking bar having first and second opposed end portions and defining a central axis, said locking bar further defining an opening spaced from said central axis for receiving a lock;

a first receptacle member adapted to be secured to one of the barrier members for receiving the first end portion of said locking bar, said first receptacle member defining an opening for receiving a lock;

a second receptacle member adapted to be secured to the other of the barrier members for receiving the second end portion of said locking bar, said first and second receptacle members and barrier members are adapted to be movable relative to each other when at least one of the first and second end portions of said elongate locking bar is removed from the respective receptacle member; and at least one coupling segment having a bore for receiving said elongate locking bar, said segment defining a pair of spaced openings each defining an axis substantially parallel to the axis of said locking bar, one of said spaced openings being adjacent to the opening of said elongate locking bar such that a lock can be inserted through both of the respective adjacent openings, and the other of said spaced openings being adjacent the opening of said first receptacle member such that a lock can be inserted through both of the respective adjacent openings.

2. A locking device as defined in claim 1 wherein said locking bar further comprises a substantially cylindrical body and a tab extending radially outwardly from said body adjacent said first end portion, and wherein said locking bar opening is defined in said tab.

3. A locking device as defined in claim 1 wherein said first receptacle member further comprises a hollow tubular body and a tab extending radially outwardly from said body adjacent said first end portion of said locking bar, and wherein said first receptacle member opening is defined in said tab.

4. A locking device as defined in claim 1 wherein said coupling segment further comprises a body defining said bore and a pair of tabs each extending radially outwardly from said body adjacent a respective end of said body, and wherein each of said spaced openings is defined in a respective one of said tabs.

5. A locking device as defined in claim 3 wherein said first receptacle member further comprises means for attaching the hollow body to the respective barrier member.

6. A locking device as defined in claim 1 wherein said second receptacle member further comprises a hollow body defining a cross section having a vertical dimension greater than a horizontal dimension.

7. A locking device as defined in claim 6 wherein said second receptacle member has a rectangular cross section.

8. A locking device as defined in claim 6 wherein said second receptacle member further comprises means for attaching the hollow body to the respective barrier member.

9. A locking device as defined in claim 1 wherein the opening of said elongate locking bar and the opening of said first receptacle member each define an axis substantially parallel to the axis of said locking bar and are configured such that the coupling segment can be removed and the openings positioned adjacent to each other such the locking device can be locked with a single lock extending through both of the respective openings.

10. A multiple access locking device capable of being opened by any one of a plurality of different locks to allow at least one of a pair of adjoining barrier members to be moved relative to the other, said device comprising:

an elongate locking bar having first and second opposed end portions and defining a central axis, said locking bar having a tab defining an opening for receiving a lock;

a first receptacle member adapted to be secured to one of the barrier members for receiving the first end portion of said locking bar, said first receptacle member having a tab defining an opening for receiving a lock;

a second receptacle member adapted to be secured to the other of the barrier members for receiving the second end portion of said locking bar, said first and second receptacle members and barrier members are adapted to be movable relative to each other when at least one of the first and second end portions of said elongate locking bar is removed from the respective receptacle member; and at least one coupling segment having a body defining a bore for receiving said elongate locking bar, said segment having a pair of spaced apart tabs each extending outwardly from said body and each defining an opening, one of said spaced tabs being adjacent to the tab of said elongate locking bar such that a lock can be inserted through the respective openings of the adjacent tabs, and the other of said spaced tabs being adjacent the tab of said first receptacle member such that a lock can be inserted through the respective openings of the adjacent tabs.

11. A locking device as defined in claim 10 wherein said first receptacle member further comprises a hollow tubular body and means for attaching the hollow body to the respective barrier member.

12. A locking device as defined in claim 10 wherein said second receptacle member further comprises a hollow body defining a cross section having a vertical dimension greater than a horizontal dimension and means for attaching the hollow body to the respective barrier member.

13. A locking device as defined in claim 12 wherein said second receptacle member has a rectangular cross section.

14. A locking device as defined in claim 10 wherein the opening of said elongate locking bar and the opening of said first receptacle member each define an axis substantially parallel to the axis of said locking bar and are configured such that the coupling segment can be removed and the openings positioned adjacent to each other such the locking device can be locked with a single lock extending through both of the respective openings.

15. A multiple access locking device capable of being opened by any number of different locks to allow at least one of a pair of adjoining barrier members to be moved relative to the other, said device comprising:

an elongate locking bar having first and second opposed end portions and defining a central axis, said locking bar further defining an opening for receiving a lock;

a first receptacle member adapted to be secured to one of the barrier members for receiving the first end portion of said locking bar, said first receptacle member defining an opening for receiving a lock;

a second receptacle member adapted to be secured to the other of the barrier members for receiving the second end portion of said locking bar, said first and second receptacle members and barrier members are adapted to be movable relative to each other when at least one of the first and second end portions of said elongate locking bar is removed from the respective receptacle member; and an odd or even number of coupling segments each having a bore for receiving said elongate locking bar, each of said segments being identically configured and defining a pair of spaced openings, each of said spaced openings being adjacent to one of the opening of said elongate locking bar, the opening of said first receptacle member and an opening of an adjacent coupling segment such that each of a number of locks can be inserted through both of a pair respective adjacent openings.

16. A locking device as defined in claim 15 wherein said locking bar further comprises a substantially cylindrical body and a tab extending radially outwardly from said body adjacent said first end portion, and wherein said locking bar opening is defined in said tab.

17. A locking device as defined in claim 15 wherein said first receptacle member further comprises a hollow tubular body and a tab extending radially outwardly from said body adjacent said first end portion of said locking bar, and wherein said first receptacle member opening is defined in said tab.

18. A locking device as defined in claim 15 wherein said coupling segment further comprises a body defining said bore and a pair of tabs each extending radially outwardly from said body adjacent a respective end of said body, and wherein each of said spaced openings is defined in a respective one of said tabs.

19. A locking device as defined in claim 15 wherein said second receptacle member further comprises a hollow body defining a cross section having a vertical dimension greater than a horizontal dimension.

20. A locking device as defined in claim 19 wherein said second receptacle member has a rectangular cross section.

* * * * *